United States Patent [19]

Strickland, Jr. et al.

[11] Patent Number: 4,874,536

[45] Date of Patent: Oct. 17, 1989

[54] SYNTHETIC SURFACTANT CAKES WITH MAGNESIUM CHLORIDE

[75] Inventors: Wilbur C. Strickland, Jr., Cincinnati; Rosstain F. Sterling, Milford, both of Ohio

[73] Assignee: The Proctor & Gamble Company, Cincinnati, Ohio

[21] Appl. No.: 625,984

[22] Filed: Jun. 29, 1984

[51] Int. Cl.[4] ..... C11D 1/12; C11D 1/755

[52] U.S. Cl. ..... 252/90; 252/554; 252/558

[58] Field of Search ..... 252/554, 558, 90

[56] References Cited

U.S. PATENT DOCUMENTS

| | | | |
|---|---|---|---|
| 1,748,533 | 2/1930 | Weissbein | 252/132 |
| 2,372,838 | 4/1945 | Luse | 252/134 |
| 2,781,320 | 2/1957 | Jelinek et al. | 252/DIG. 16 |
| 2,781,321 | 2/1957 | Mayhew et al. | 252/556 |
| 4,278,571 | 7/1981 | Choy | 252/174.26 |
| 4,310,434 | 1/1982 | Choy et al. | 252/174.21 |

*Primary Examiner*—A. Lionel Clingman
*Assistant Examiner*—John F. McNally
*Attorney, Agent, or Firm*—Leonard Williamson; Ronald L. Hemingway; Richard C. Witte

[57] ABSTRACT

A solid water-soluble cake comprising: from 20% to 90% sodium alkyl sulfate (AS)/sodium alkyl benzene sulfonate (LAS), co-surfactant having a 1:1.5 to 1.5:1 ratio and from 0.5% to 25% by weight magnesium chloride. One key advantage is that the cakes of this invention have a more constant dissolution rate over a wider range of water temperatures than comparable cakes made without the $MgCl_2$. The cakes are used in automatic toilet bowl cleanser dispensers.

12 Claims, No Drawings

SYNTHETIC SURFACTANT CAKES WITH MAGNESIUM CHLORIDE

TECHNICAL FIELD

The present invention relates to surfactant cakes for automatic toilet bowl cleaning products. Such cakes are particularly useful in conjunction with a toilet tank dosing dispenser which automatically dispenses a ration of surfactant, perfume, and/or dye, and optionally other ingredients to the bowl of a toilet, responsive to the flushing of the toilet.

BACKGROUND

This invention relates to surfactant cake compositions which are used in automatic dispensing devices. Examples of such cakes are disclosed in U.S. Pat. No. 4,308,625, Kitko, issued Jan. 5, 1982; U.S. Pat. No. 4,310,434, Choy and Greene, issued Jan. 12, 1982; and U.S. Pat. No. 4,278,571, Choy, issued July 14, 1981, entitled "Surfactant Cake Compositions". The surfactants provide sudsing in the toilet bowl and also serve to disperse other components of the compositions such as dyes, perfumes, organic resins, etc. Anionic surfactants, especially the organic sulfates and sulfonate types, are used in these compositions because of their availability, low cost and dispensing properties.

Water-soluble inert salts such as alkali metal chlorides and sulfates are used in such compositions to act as a "filler" so that the composition can be formed into cakes of desirable size without using excessive amounts of active ingredients. The predominant ingredients of the cake compositions are usually the surfactant, perfume and the filler salt. Anionic, nonionic, zwitterionic or cationic surfactants are used. The surfactant or surfactant mixture should be solid at temperatures up to about 100° F. (40° C.). Anionics and nonionics and mixtures thereof are useful. Anionics are the most preferred.

The prior art anionic surfactant cakes can be described as essentially the water-soluble alkali metal salts, of organic sulfuric reaction products having in their molecular structure an alkyl or an alkylaryl radical containing from 8 to 22 carbon atoms.

A major problem in this art has been short and/or erratic longevity of surfactant cakes. Another problem is related to the incorporation of higher levels of perfume into surfactant cake formulations while maintaining desired firmness. Yet another problem is erratic dissolution rate due to water temperature changes.

SUMMARY OF THE INVENTION

This invention is directed to a solid water-soluble cake comprising: from 20% to 90% AS/LAS co-surfactant having a 1:1.5 to 1.5:1 ratio and from 0.5% to 25% by weight magnesium chloride. The cakes of this invention are made from drum drying a water-wet paste containing sodium alkyl sulfate (AS), sodium alkyl benzene sulfonate (LAS), and magnesium chloride, or preferably a sodium chloride and magnesium chloride blend. The $MgCl_2$/NaAS/LAS surfactant flakes are blended with other ingredients to make the more economical, longer lasting, improved surfactant cakes. One key advantage is that the dissolution rate of cakes of this invention is more stable over a wider range of water temperatures.

DETAILS OF THE INVENTION

Composition

The essential element of this invention is magnesium chloride and sodium AS/LAS co-surfactant. The co-surfactant system has a ratio of 1:1.5 to 1.5:1, preferably about a 1:1 mixture, of the sodium $C_9$-$C_{15}$ alkyl sulfate (AS) and sodium $C_9$-$C_{15}$ alkyl benzene sulfonate (LAS). The most preferred AS is often called lauryl sulfate and is derived from coconut oil, and the most preferred LAS is often called lauryl benzene sulfonate. AS is needed for its solubility and processing properties. LAS is needed for its perfume absorbing property which is desirable in one of the flakes' primary uses. The AS/-LAS surfactants, including impurities, are present in the flakes at a level of from 90% to 99.5%, preferably 92% to 95%. The flakes preferably contain 38% to 52% AS, 33% to 47% LAS, 0.5% to 10% $MgCl_2$/NaCl, and up to 1.8% moisture.

Preferred flake starting materials contain sodium chloride and magnesium chloride, in an amount of 0.5% to 10% by weight of the flakes, preferably from 6% to 8.5%.

A third element is residual water in an amount up to about 1.8% by weight of the flakes, preferably less than 1.2%, and more preferably less than about 1%.

A buffer is highly desirable to improve flake and cake storage stability. The preferred buffer for the surfactant system is sodium carbonate which is added to the wet paste and is present in the flake at a level of from about 0.2% to about 3% part per part of the AS surfactant. Other buffers can be used. The pH of the buffered surfactant flake is from about 7 to about 9.5, preferably 7.5 to 8.5.

All percentages and ratios herein are "by weight" unless specified otherwise. The flake compositions herein will be described with particular reference to their use in conjunction with surfactant cakes for dispensers which dispense the chemicals into the flush water of toilets, although it is to be understood that said flake compositions can be used in other applications where surfactant flakes or solid surfactant cakes are desired.

Preferred Process for Making the Flakes

Hot, drum dried $MgCl_2$/sodium alkyl sulfate/sodium alkyl benzene sufonate ($MgCl_2$/AS/LAS) flakes are cooled in a dry gas environment at a dewpoint of 10° C. or below to prevent insidious hydration and to provide stable flakes. The flakes, which are 0.5% to 10% $MgCl_2$/NaCl and 90% to 99.5% AS/LAS surfactant, are made from a water-wet paste of $MgCl_2$/NaCl/AS/-LAS. The paste is dried on a heated roll drum dryer and removed with a doctor blade. The hot flakes are cooled in a lower moisture atmosphere. The process steps are summarized as:

1. Forming a 25° C. to 95° C., preferably 38° C. to 66° C., water-wet paste of the $MgCl_2$/NaCl/AS/LAS and, optionally a buffer to adjust the pH of the paste to 7 to 9.5 for rapid processing stability. The paste should have a moisture content of from about 25% to about 60%. The paste is preferably pre-dried to about 50% to about 70% solids to improve the efficiency of the drum dryer.

2. Roll drying the heated paste on a heated roll drum dryer at a temperature of 120° C., preferably 150° C. to 175° C., to provide hot flakes having a moisture content of up to about 1.8, preferably up to bout 1.2%, and a thickness of 0.1 to 1.3 mm.

3. Cooling the hot flakes in a dry gas environment having a dewpoint of up to 10° C., preferably below 0° to 4° C. The flakes are cooled to about ambient temperature or below.

The dry gas, preferably dry nitrogen or dry air, must have a dewpoint of less than about 10° C. The flakes comprise, in percentages by weight, 90 to 99.5% of a mixture of (1) sodium alkyl sulfate, (2) sodium alkyl benzene sulfonate having a weight ratio of 1:1.5 to 1.5:1, and (3) from 0.5% to 10% of the magnesium chloride, preferably a blend of sodium chloride and magnesium chloride. The cooled flakes can have a moisture content of up to about 1.8, preferably up to about 1.2%. The stabilized flakes are used to make improved aesthetic cakes. It has been discovered that the improved $MgCl_2$/AS/LAS flakes consistently yield harder, longer lasting aesthetic perfumed cakes than comparable cakes made with flakes cooled at higher dewpoints.

More specifically, a wet paste is prepared by mixing the elements of the flakes: AS, LAS, magnesium chloride and water, with enough water to bring the total moisture content of the paste to from 40% to by 60% by weight of the paste, preferably from 45% to 55%. A buffer, e.g., sodium carbonate, can be used at a level of 0.2% to 3% part per part of AS to provide a pH of from 7 to 9, preferably 7.5 to 8.5. This pH allows a more rapid manufacture of stable coflakes using higher temperatures.

The temperature of the paste is raised preferably to from 25° C. up to 95° C., more preferably to from 38° C. to 66° C. Viscosity of the paste is preferably from 100 to 10,000 centipoises, more preferably from 1,000 to 5,000 centipoises, when measured by a Brookfield rotating viscometer using a No. 3 spindle at a speed of 30 rpm. Preferably, $MgCl_2$ and sodium chloride are used to adjust the viscosity of the paste. A broad range of viscosity is acceptable as long as the paste can be handled. For further ease of handling and to increase the processing rate, the paste is preferably concentrated in a predryer, preferably a plate and frame heat exchanger or a wiped film evaporator, to a moisture level of 30% to 50%, more preferably about 40%.

Flakes are formed by pumping the paste into the trough between two heated rolls. Most of the water is removed, and a sheet of hot, dried material which forms on the drum is flaked off with a doctor blade. The hot, dried flakes are carefully cooled in a low moisture environment, e.g., under a dry air blanket or a dry nitrogen blanket, to avoid undesirable, insidious hydration. The dry air or nitrogen should have a dewpoint of 10° C. or below. Examples of commercially available equipment used to produce dry air are: (1) Van Air Regenerative Air Dryer, made by the Van Air Systems, Inc., Co., and (2) refrigeration equipment made by King Refrigeration Mfg. Co.

An exhaust system is required to remove excess steam from above and beneath the drum dryer. A drum dryer like the one discussed in the above-cited Lazar & Miers Food Technology publication can be modified for use in the practice of this invention. The rolls on the drum dryer must be hot enough to dry the paste. The preferred temperatures are from 140° C. to 190° C., more preferably 155° C. to 175° C.

Flake thickness is from 0.1 mm to 1.3 mm, preferably from 0.2 mm to 1.0 mm, more preferably from about 0.2 mm to about 0.6 mm. Measurement can be made by any number of devices, for example, a micrometer or a thickness gauge.

Bulk density of the flakes is from 0.08 to 0.24 gm/cc, preferably from 0.11 to 0.16 gm/cc. The term bulk density means that of a mass of flakes when they are poured gently into a volumetric measure.

The flakes can be stored in a sealed moisture-proof container, preferably in a cooler at a temperature below about 10° C.

The flakes made by this preferred process have free flowing and noncaking properties.

The Magnesium Chloride

Magnesium chloride is required to make the cake of this invention. Blends of magnesium chloride and sodium chloride are preferably included in the paste at levels of from 0.5% to 10% by weight of the AS/LAS surfactant. Sodium chloride's primary use is to adjust the viscosity and improve the flaking property of the paste. The $MgCl_2$ is used to stabilize the end product which is a cake.

In the cake made from the coflakes blends of other inorganic salts can be included up to about 40%, preferably 20% to 35% total inorganic salts. About 25% to about 28% total inorganic salts is optimum for the preferred cake compositions which are set out in Examples V(A) and V(B). The preferred $MgCl_2$/NaCl ratio is from 1:5 to 1:20, preferably 1:10 to 1:14.

The addition of water-soluble magnesium salts to the surfactant (AS and LAS) paste mix prior to drum drying can increase the longevity of the cake made from the flakes. Further, the selection of the type of magnesium salt used to achieve this longevity improvement has an important influence on the dissolution characteristics of the cake.

Longevity testing of cakes for automatic toilet bowl cleaning (ATBC) products is typically done in dispensers at water temperatures of 40°, 60° and 80° F. which are respectively about 4.4°, 15.6° and 26.7° C. A performance parameter known as the temperature coefficient (Tc) has been established to describe the difference in longevity (solubility) between the two temperature extremes. Example:

$$Tc = \frac{\text{Longevity (days) @ 40° F. and } x \text{ flushes per day } (Fpd)}{\text{Longevity (days) @ 80° F. and } x \text{ flushes per day}}$$

where x is in the range 10 to 14

Tc=45 days/21 days=2.14

For ATBC products, it is desirable for the Tc to be as low as possible. In a co-dispensing product this is an important attribute as one of the functions of a surfactant dye solution is to signal the consumer when the active bleach material has been depleted and the product should be replaced. The dissolution rate of the bleach tablet is only slightly affected by temperature fluctuations; therefore, the dissolution rate of the surfactant cake should be closely matched to the bleach cake so that they are depleted simultaneously.

When using magnesium salts in surfactant cake formulations containing AS/LAS flakes to achieve improved longevity, it has been learned that it is more appropriate to use $MgCl_2$ than $MgSO_4$, as plugs with the chloride salt have better (lower) Tc values than their sulfate counterparts.

An experiment was performed where different combinations of AS, LAS, sodium chloride and magnesium chloride or magnesium sulfate were used to form surfactant cakes. The purpose of this work was to study the effects of these two magnesium salts on longevity and temperature coefficient. The formulas and their temperature coefficients are detailed in the following table:

TABLE 2

| Observation | AS:LAS Ratio | $MgCl_2$ Wt. % | $MgSO_4$ Wt. % | Tc Week 2 | Tc Week 3 | Tc Week 4 |
|---|---|---|---|---|---|---|
| Control | 1.00 | — | — | 2.30 | 2.14 | 2.18 |
| 1 | 1.20 | 3.55 | — | 2.29 | 1.80 | 1.69 |
| 2 | 1.20 | — | 3.76 | 2.61 | 2.42 | 2.24 |
| 3 | 1.10 | 2.04 | — | 1.92 | 1.78 | 1.69 |
| 4 | 1.10 | — | 2.16 | 2.57 | 2.23 | 2.13 |
| 5 | 1.05 | 0.99 | — | 2.42 | 1.85 | 1.88 |
| 6 | 1.05 | — | 1.04 | 2.43 | 2.23 | 2.00 |
| 7 | 1.00 | 2.04 | — | 2.04 | 1.76 | 1.69 |
| 8 | 1.00 | — | 2.15 | 2.48 | 1.96 | 1.76 |

Note: All cakes contained equal amounts of perfume and dye, 11% and 1.7%, respectively. The temperature coefficients are derived from predicted longevities of the products at the indicated time of the measurement. The amount of cake dissolved over that time period (i.e., 2 weeks) is compared to the initial cake length and the time (days) until complete dissolution is determined.

Observe that in the above cases where the weight percent $MgCl_2$ is roughly equal to $MgSO_4$ that the Tc value is consistently lower for the $MgCl_2$ version. It has been theorized that some of the NaAS/NaLAS is converted to $Mg(AS)_2/Mg(LAS)_2$ in the presence of $MgCl_2$ or $MgSO_4$ during the processing of the paste mix to a dry form. If this is the case, the presence of sodium chloride (a by-product of the above reactions with $MgCl_2$) is important and benefits the dissolution properties in a more advantageous manner than sodium sulfate (a by-product of the above reactions with $MgSO_4$). It should be noted that the weight percent $MgCl_2/MgSO_4$ is reported on a nonreacted/nondissociated basis.

The Dyes

Dyes may be included at levels of from about 0.5% to 12%, preferably 1.0% to 5%. It is highly desirable that the cakes have a pH of less than about 8.5 for dye stability. Examples of suitable dyes are Alizarine Light Blue B (C.I. 63010), Carta Blue VP (C.I. 24401), Acid Green 2G (C.I. 42085), Astrogen Green D (C.I. 42040) , Supranol Cyanaine 7B (C.I. 42675), Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the patents of Kitko, U.S. Pat. No. 4,200,606, issued Apr. 29, 1980, and U.S. Pat. No. 4,248,827, issued Feb. 3, 1981, both incorporated herein by reference.) C.I. refers to Color Index.

It has been noted that the use of $MgCl_2$ helps to minimize the temperature coefficient (Tc) value which is desirable for an ATBC product. It has been observed that the use of $MgCl_2$ has an additional advantage as it serves to diminish the negative impact on Tc that often results from increasing the dye content in AS/LAS surfactant cake formulation. In other words, the appropriate addition of $MgCl_2$ to the AS/LAS cake formula serves to counteract an increase in Tc that is associated with an increase in dye content.

Utility

The utility of the improved solid cakes is for use in conjunction with toilet water dosing dispensers.

The manufacture of solid cakes from the surfactant flakes is related to the art of forming bars of toilet soap. The flakes are blended into a homogeneous mass with other raw materials such as perfumes, dyes, etc., and noodled, plodded, extruded, cut or stamped to form uniform bars or cakes. Firm cakes having a hardness penetrometer value of less than 120, preferably between 40–100, and most preferably about 65 or less, are preferred.

The composition of a preferred cake is made with about 2% magnesium chloride having an AS/LAS ratio of 1:1; 11% perfume; about 1.7% dye; about 24% sodium chloride; 0.17% $Na_2CO_3$; and less than 1% moisture. About 0.2% talc is put on the surface of the finished cake as a packing aid.

Dispensers

Such cakes are particularly useful in conjunction with a toilet tank dosing dispenser which automatically dispenses a ration of surfactant, perfume, and/or dye, and optionally other ingredients to the bowl of a toilet, responsive to the flushing of the toilet.

In treating toilet flush water with chemicals in order to produce desirable effects such as bowl aesthetics, cleaning disinfection, deodorization, aerosol reduction, etc., it is desirable that the chemicals be dispensed into the flush water automatically each time the toilet is flushed. Numerous devices which have been designed for this purpose. Exemplary of such devices are disclosed in:

U.S. Pat. No. 4,171,546, Dirksing, issued Oct. 23, 1979;
U.S. Pat. No. 4,186,856, Dirksing, issued Feb. 5, 1980;
U.S. Pat. No. 4,200,606, Kitko, issued Apr. 29, 1980;
U.S. Pat. No. 4,208,747, Dirksing, issued June 24, 1980;
U.S. Pat. No. 4,216,027, Wages, issued Aug. 5, 1980;
U.S. Pat. No. 4,246,129, Kacher, issued Jan. 20, 1981;
U.S. Pat. No. 4,247,070, Dirksing, issued Jan. 27, 1981;
U.S. Pat. No. 4,248,827, Kitko, issued Feb. 3, 1981;
U.S. Pat. No. 4,251,012, Williams et al., issued Feb. 17, 1981;
U.S. Pat. No. 4,253,951, McCune, issued Mar. 3, 1981;
U.S. Pat. No. 4,281,421, Nyquist et al., issued Aug. 4, 1981;
U.S. Pat. No. 4,283,300, Kurtz, issued Aug. 11, 1981;
U.S. Pat. No. 4,302,350, Callicott, issued Nov. 24, 1981;
U.S. Ser. No. 355,984, Mueller et al., filed Mar. 8, 1982; and
European Pat. Appln. 0,005,286, Nyquist, published Nov. 14, 1979.

Particularly desirable devices are those comprising a solid cake composition. In this type of device a measured amount of water enters the device during one flush cycle and remains in contact with the cake between flushes, thereby forming a concentrated solution of the composition which is dispensed into the flush water during the next flush. The advantages of such devices are that the chemical composition can be packaged and shipped in more concentrated form than aqueous solutions of the chemicals. Also, the problems of liquid spillage resulting from breakage of the dispensers during shipment or handling is eliminated. Especially preferred devices for automatic dispensing of chemicals from solid cake compositions into the toilet are those generally described in U.S. Pat. No. 4,171,546, Dirksing, issued Oct. 23, 1979; U.S. Pat. No. 4,208,747, Dirksing, issued June 24, 1980; U.S. Pat. No. 4,186,856, Dirksing, issud Feb. 5, 1980. Details of a preferred dispensing means are disclosed in commonly owned U.S. pat. appln. Ser. No. 452,543, Dirksing et al. entitled "Article and Method for Maintaining More Even Concentrations of Bleach in a Passive Dosing Dispenser," filed Dec. 23, 1982, incorporated herein by reference.

Perfumes

Perfumes are an important ingredient for surfactant cake compositions. Perfume is usually used at levels of from 5% to 20%, but levels of from 9% to 20% perfumes are preferred. In U.S. Pat. No. 4,246,129, Kacher, issued Jan. 20, 1981 (incorporated herein by reference), certain perfume materials are disclosed which perform the added function of reducing the solubility of anionic sulfonate and sulfate surfactants. At higher levels of perfumes in certain compositions, e.g., around 12% and higher, the softness of the cake could be a serious processing problem. This is particularly so in compositions based on larger proportions of alkali metal alkyl sulfate surfactants. LAS is a better carrier of perfume in terms of maintaining desired cake firmness; AS provides better cake solubility.

Perfumes are complex compositions. Table I shows two acceptable perfumes useful in making cakes from the flakes of the present invention.

TABLE 2

| Perfume Formula - 1-A | |
|---|---|
| Component | Weight % |
| Isobornyl Acetate | 31.0 |
| d'Limonene | 20.0 |
| 4-Tertiary Butyl Cyclohexyl Acetate | 5.0 |
| Tricyclo Decenyl Propionate | 5.0 |
| Amyl Cinnamic Aldehyde | 8.0 |
| Anisic Aldehyde | 3.0 |
| Iso Cyclo Citral | 1.0 |
| Methyl Nonyl Acetaldehyde | 1.0 |
| Citrathal | 3.0 |
| Benzyl Acetate | 10.0 |
| Patchouli | 3.0 |
| Beta Pinene | 1.0 |
| Diphenyl Oxide | 2.0 |
| Gamma Dodecalactone | 0.5 |
| Delta Undecalatone | 0.5 |
| Gamma Methyl Ionone | 1.0 |
| Geranyl Nitrile | 2.0 |
| Labdanum Claire | 2.0 |
| Ligustral | 1.0 |
| Total | 100.0% |

| Perfume Formula - 1-B | |
|---|---|
| Component | Weight % |
| Isobornyl Acetate | 10.0 |
| Lavandin | 15.0 |
| d'Limonene | 20.0 |
| Lemon Oil C.P. | 20.0 |
| 4-Tertiary Butyl Alpha Methyl Hydrocinnamic Aldehyde | 10.0 |
| Methyl Heptine Carbonate | 0.1 |
| Para Cresyl Methyl Ether | 1.0 |
| Anisic Aldehyde | 5.0 |
| Peppermint Oil | 0.5 |
| Phenyl Acetaldehyde Dimethyl Acetal | 2.0 |
| Lauric Aldehyde | 1.0 |
| Iso Hexenyl Cyclohexenyl Carboxaldehyde | 2.0 |
| Methyl Iso Butenyl Tetrahydro Pyran | 0.5 |
| Vetigreen 1% in D.E.P | 0.1 |
| Ethyl Methyl Phenyl Glycidate | 0.8 |
| Diphenyl Oxide | 1.0 |
| Musk Xylol | 5.0 |
| Methyl Salicylate | 1.0 |
| 1-8-Cineole | 1.0 |
| Aurantiol | 3.0 |
| Ligustral | 1.0 |
| Total | 100.0% |

Cake Firmness

The firmness of the cake is measured by the use of a penctrometer. An acceptable penetrometer reading is around 120, and preferably from 40 to 100, using a Lab-Line Universal Penetrometer equipped with wax penetration needle ASTM D1321, Cat. No. 4101.

Operation:

Level base and place 100 gm and 50 gm weights on plunger top. Place bar on cut end beneath penetrometer needle, raised to the zero position. Lower needle (via elevator screw) until needle just touuches plug end. Depress trigger for 10 seconds (needle will lower into cake, then release. To read hardness, lower depth gauge bar until it just touches plunger.

Hardness readings are taken directly from the gauge, in units of tenths of millimeters. Penetration decreases as hardness increases.

Raise the needle to zero position, remove plug, and record plug temperature.

EXAMPLES

In the examples below, unless otherwise stated, all AS and LAS references mean sodium lauryl sulfate, and sodium lauryl benzene sulfonate. A preferred embodiment of the invention will be illustrated by nonlimitng Example IV, formulation B.

EXAMPLE I

This examples sets out the preferred procedure for making AS/LAS coflakes. The cake (Example II) made from the flakes of this example is inferior to a cake made with $MgCl_2$. However, the procedure steps for making flakes are basically the same. The following formula (102 kg batch) was put into a steam-jacketed crutcher with agitation and recirculation:

| Ingredients | Parts |
|---|---|
| AS (29% active)* | 74.11 |
| LAS (90% active)** | 22.23 |
| NaCl | 3.18 |
| $Na_2CO_3$ (25% active) | 0.48 |
| | 100.00 |

*EQUEX-S, manufactured by The Procter & Gamble Company, is a 29% solution of sodium lauryl sulfate and 1% additional solids.

This crutcher paste consisted of:

| Ingredients | Parts |
|---|---|
| AS | 21.49 |
| LAS | 20.01 |
| NaCl | 3.18 |
| $Na_2CO_3$ | 0.12 |
| $H_2O$ | 52.24 |
| $H_2O$ | 52.24 |
| Misc. solids from AS and LAS | 2.96 |
| | 100.00 |

This paste was heated to about 60° C., and had a pH of about 8.7 and a viscosity which varied from 1000 to 5000.

After about 1 hour of mixing, the paste was concentrated to about 35% moisture in a plate and frame heat exchanger and then pumped to a drum rol dryer, having a temperature of about 160° C., and dried into flakes. The flakes were cooled in a conveyor shoot under a blanket of dry air having a dewpoint of less than 4° C.

which was provided by a Van Air Regenerative Air Dryer. The flakes had the following composition:

| Ingredients | Parts |
|---|---|
| AS | 44.55 |
| LAS | 41.48 |
| NaCl | 6.59 |
| $Na_2CO_3$ | 0.25 |
| $H_2O$ | 1.00 |
| Misc. solids | 6.13 |
| | 100.00 |

EXAMPLE II

The flakes of Example I were blended with perfume, additional NaCl, and dye at ambient conditions using the following formula:

| Ingredients | Parts |
|---|---|
| Flakes | 65.6 |
| Perfume | 11.0 |
| NaCl (added) | 21.7 |
| Dye | 1.7 |
| | 100.0 |

The total NaCl in the system was about 26%. It is noted that some NaCl was brought into the system with the flakes.

The composition was mixed well and plodded and then extruded through a 1.3 cm×4.9 cm orifice into strips. During extrusion the composition had a temperature of about 26° C. The strips were then cut into cakes of approximately 6.4 cm in length. The cakes had a pH of about 8.5.

The cakes had an average finished hardness penetrometer value of 91.

EXAMPLE III

Using the procedures set out in Example I, the following flakes were made as follows:

| Crutcher Ingredients | Parts |
|---|---|
| AS (29% active) | 72.44 |
| LAS (90% active) | 21.72 |
| NaCl | 2.27 |
| $MgCl_2 \cdot 6\ H_2O$ | 3.08 |
| $Na_2CO_3$ (25% active) | 0.49 |
| | 100.00 |

The crutcher paste consisted of:

| Ingredients | Parts |
|---|---|
| AS | 21.01 |
| LAS | 19.55 |
| NaCl | 2.27 |
| $MgCl_2$ | 1.44 |
| $Na_2CO_3$ | 0.12 |
| $H_2O$ | 52.72 |
| Misc. solids from AS and LAS | 2.89 |
| | 100.00 |

This paste was heated to about 60° C., and had a pH of about 8.7 and a viscosity which varied from 1000 to 5000.

After about 1 hour of mixing, the paste was concentrated to about 35% moisture in a plate and frame heat exchanger and then pumped to a drum roll dryer, having a temperature of about 160° C., and dried into flakes. The flakes were cooled in a conveyor shoot under a blanket of dry air having a dewpoint of less than 10° C., which was provided by a Van Air Regenerative Air Dryer. The flakes had the following composition:

| Ingredients | Parts |
|---|---|
| AS | 44.00 |
| LAS | 40.94 |
| NaCl | 4.75 |
| $MgCl_2$ | 3.02 |
| $Na_2CO_3$ | 0.25 |
| $H_2O$ | 1.00 |
| Misc. solids | 6.04 |
| | 100.00 |

EXAMPLE IV

Cakes A and B were made using the procedure of Example II and the flakes were made using the procedures of Examples I and III, respectively. Note that the cake formulation of cake "A" is slightly different from the cake of Example II.

| Component | A (Wt. %) | B (Wt. %) |
|---|---|---|
| NaAS | 30.73 | 30.70 |
| NaLAS | 30.66 | 30.69 |
| NaCl | 25.80 | 23.76 |
| $MgCl_2$ | — | 2.04 |
| $Na_2CO_3$ | 0.17 | 0.17 |
| Dye | 1.66 | 1.66 |
| Perfume | 10.98 | 10.98 |
| | 100.00% | 100.00% |
| Longevity @ 60° F.~15.6° C. | | |
| 14 flushes per day | 31 ± 4 | 37 ± 6 |
| Tc (4 week value) | 2.18 | 1.69 |

Notice that the cake containing the $MgCl_2$ has increased longevity (37±6 vs. 31±4) and an improved (smaller) Tc value (1.69 vs. 2.18).

What is claimed is:

1. A solid water-soluble toilet bowl cleaning cake consisting essentially of from 20% to 90% $C_9$-$C_{15}$ alkyl sulfate $C_9$-$C_{15}$ alkyl benzene sulfonate co-surfactant having a 1:1.5 to 1.5:1 ratio and from 0.5% to 25% weight magnesium chloride wherein said cake is present in a dosing toilet bowl dispenser.

2. The invention of claim 1 wherein said cake comprises a blend of magnesium chloride and sodium chloride present at a level of from 0.5% to 40% by weight of said cake.

3. The invention of claim 2 wherein said blend is present at a level of from 20% to 35% and the ratio of sodium chloride to magnesium chloride is 5:1 to 20:1.

4. The invention of claim 3 wherein the ratio of said blend is 10:1 to 14:1.

5. The invention of claim 1 wherein said cake contains from 5% to 20% perfume and from 0% to 12% dye.

6. The cake of claim 5 wherein said cake contains from 9% to 20% perfume and from 0.5% to 2.0% dye.

7. The cake of claim 5 wherein said cake contains from 9% to 20% perfume and from 1.0% to 5.0% dye.

8. The cake of claim 1 wherein said cake also contains a buffer.

9. The invention of claim 1 wherein said alkyl sulfate and alkylbenzene sulfonate have a weight ratio of from 0.8:1 to 1:0.8.

10. The invention of claim 1 wherein said co-surfactant ratio is about 1:1.

11. The invention of claim 1 wherein said alkyl groups are both lauryl.

12. A method of improving the longevity of a solid water-soluble toilet bowl cleaning cake which is made from a mix containing from 20% to 90% $C_9$-$C_{15}$ alkyl sulfate flakes/$C_9$-$C_{15}$ alkyl benzene sulfonate co-surfactant flakes having a 1:1.5 to 1.5:1 ratio, the improvement consisting essentially of adding to said co-surfactant mix from 0.5% to 25% by weight magnesium chloride wherein said cake is present in a dosing toilet bowl dispenser.

* * * * *

UNITED STATES PATENT AND TRADEMARK OFFICE

CERTIFICATE OF CORRECTION

PATENT NO. : 4,874,536

DATED : October 17, 1989

INVENTOR(S) : Wilbur C. Strickland, Jr. and Rosstain F. Sterling

It is certified that error appears in the above-identified patent and that said Letters Patent is hereby corrected as shown below:

On the title page:

[73] Assignee - "Proctor" should read -- Procter --.

Col. 2, line 67, after "120° C." insert -- to 190° C. --.

Col. 8, line 47, insert -- **Calsoft F-90 is a 90% sodium alkyl benzene powder with an average alkyl chain length of 11.3, manufactured by Pilot Chemical Co. --.

Col. 8, line 56, the second occurrence of "$H_2O$ 52.24" should be deleted.

Signed and Sealed this

Twenty-fourth Day of September, 1991

*Attest:*

HARRY F. MANBECK, JR.

*Attesting Officer*

*Commissioner of Patents and Trademarks*